US010540956B2

(12) United States Patent
Ohtani et al.

(10) Patent No.: US 10,540,956 B2
(45) Date of Patent: Jan. 21, 2020

(54) TRAINING APPARATUS FOR SPEECH SYNTHESIS, SPEECH SYNTHESIS APPARATUS AND TRAINING METHOD FOR TRAINING APPARATUS

(71) Applicant: Kabushiki Kaisha Toshiba, Minato-ku, Tokyo (JP)

(72) Inventors: Yamato Ohtani, Kawasaki Kanagawa (JP); Kouichirou Mori, Kawasaki Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 15/257,247

(22) Filed: Sep. 6, 2016

(65) Prior Publication Data

US 2017/0076715 A1 Mar. 16, 2017

(30) Foreign Application Priority Data

Sep. 16, 2015 (JP) ..... 2015-183092

(51) Int. Cl.
*G10L 13/04* (2013.01)

(52) U.S. Cl.
CPC ..... *G10L 13/04* (2013.01)

(58) Field of Classification Search
USPC ..... 704/235, 258, 260, 261
See application file for complete search history.

(56) References Cited

U.S. PATENT DOCUMENTS

2011/0123965 A1* 5/2011 Yu ..... G09B 19/04 434/156
2011/0218804 A1* 9/2011 Chun ..... G06F 17/289 704/243

(Continued)

FOREIGN PATENT DOCUMENTS

JP 2002-244689 A 8/2002
JP 2003-271171 A 9/2003

(Continued)

OTHER PUBLICATIONS

U.S. Appl. No. 15/185,259, filed Jun. 17, 2016, Nasu, et al.

(Continued)

*Primary Examiner* — Leonard Saint Cyr
(74) *Attorney, Agent, or Firm* — Knobbe, Martens, Olson & Bear, LLP

(57) ABSTRACT

According to one embodiment, a training apparatus for speech synthesis includes a storage device and a hardware processor in communication with the storage device. The storage stores an average voice model, training speaker information representing a feature of speech of a training speaker and perception representation information represented by scores of one or more perception representations related to voice quality of the training speaker, the average voice model constructed by utilizing acoustic data extracted from speech waveforms of a plurality of speakers and language data. The hardware processor, based at least in part on the average voice model, the training speaker information, and the perception representation score, train one or more perception representation acoustic models corresponding to the one or more perception representations.

9 Claims, 7 Drawing Sheets

(56) References Cited

U.S. PATENT DOCUMENTS

| | | | | |
|---|---|---|---|---|
| 2012/0065961 | A1 | 3/2012 | Latorre et al. | |
| 2014/0114663 | A1* | 4/2014 | Lin | G10L 13/033 704/260 |
| 2016/0093289 | A1* | 3/2016 | Pollet | G10L 13/027 704/260 |

FOREIGN PATENT DOCUMENTS

| | | | |
|---|---|---|---|
| JP | 2007-219286 | A | 8/2007 |
| JP | 2009-042553 | A | 2/2009 |
| JP | 2010-237323 | | 10/2010 |
| JP | 2014-206875 | A | 10/2014 |

OTHER PUBLICATIONS

Tachibana, M., et al., "A technique for controlling voice quality of synthetic speech using multiple regression HSMM," in Proc. INTERSPEECH2006-ICSLP, p. 2438-2441, 2006.

Kobayashi, K., et al., "Voice timbre control based on perceptual age in singing voice conversion," IEICE Trans. Inc. & Syst., vol. 97-D, No. 6, 2014.

Yamagishi, J., et al., "Average-voice-based speech synthesis using HSMM-based speaker adaptation and adaptive training," IEICE Transactions Information & Systems, vol. E90-D, No. 2, p. 533-543, Feb. 2007.

Yamagishi, J., et al., "A study on a context clustering technique for average voice models," IEICE, SP2002-28, p. 25-30, 2002.

Wan, V., et al., "Combining multiple high quality corpora for improving HMM-TTS," Proc., INTERSPEECH, Tue. O5d. Sep. 1, 2012.

Tachibana, et al., "An MRHSMM-based voice quality control technique for synthetic speech using speaker adaptation from average voice model", The Institute of Electronics, Information and Communication Engineers, IEICE Technical Report, 108(265):41-46 (Oct. 2008).

"Examination of the quality of voice control of the synthetic voice based on multiple regression HSMM", Acoustical Society of Japan 2006 spring research presentation meeting lecture collected papers [CD-ROM], Mar. 2006, p. 297-298.

* cited by examiner

FIG.2

103

TRAINING SPEAKER ID: M001

| | |
|---|---|
| GENDER: | +5.3 |
| AGE: | +2.4 |
| BRIGHTNESS: | -3.4 |
| DEEPNESS: | +1.2 |
| CLEARNESS: | +0.9 |

TRAINING SPEAKER ID: F001

| | |
|---|---|
| GENDER: | -2.1 |
| AGE: | +3.8 |
| BRIGHTNESS: | +0.1 |
| DEEPNESS: | -0.2 |
| CLEARNESS: | +1.6 |

⋮

TRAINING APPARATUS FOR SPEECH SYNTHESIS, SPEECH SYNTHESIS APPARATUS AND TRAINING METHOD FOR TRAINING APPARATUS

CROSS-REFERENCE TO RELATED APPLICATIONS

This application is based upon and claims the benefit of priority from Japanese Patent Application No. 2015-183092, filed Sep. 16, 2015, the entire contents of which are incorporated herein by reference.

FIELD

Embodiments described herein relates to speech synthesis technology.

BACKGROUND

Text speech synthesis technology that converts text into speech has been known. In the recent speech synthesis technology, statistical training of acoustic models for expressing the way of speaking and tone when synthesizing speech has been carried out frequently. For example, speech synthesis technology that utilizes HMM (Hidden Markov Model) as the acoustic models has previously been used.

BRIEF DESCRIPTION OF THE DRAWINGS

FIG. 2 illustrates an example of the perception representation score information according to the first embodiment.

DETAILED DESCRIPTION

According to one embodiment, a training apparatus for speech synthesis includes a storage device and a hardware processor in communication with the storage device. The storage stores an average voice model, training speaker information representing a feature of speech of a training speaker and perception representation information represented by scores of one or more perception representations related to voice quality of the training speaker, the average voice model constructed by utilizing acoustic data extracted from speech waveforms of a plurality of speakers and language data. The hardware processor, based at least in part on the average voice model, the training speaker information, and the perception representation score, train one or more perception representation acoustic models corresponding to the one or more perception representations.

Hereinafter, embodiments of the present invention are described with reference to the drawings.

First Embodiment

Figure 1:
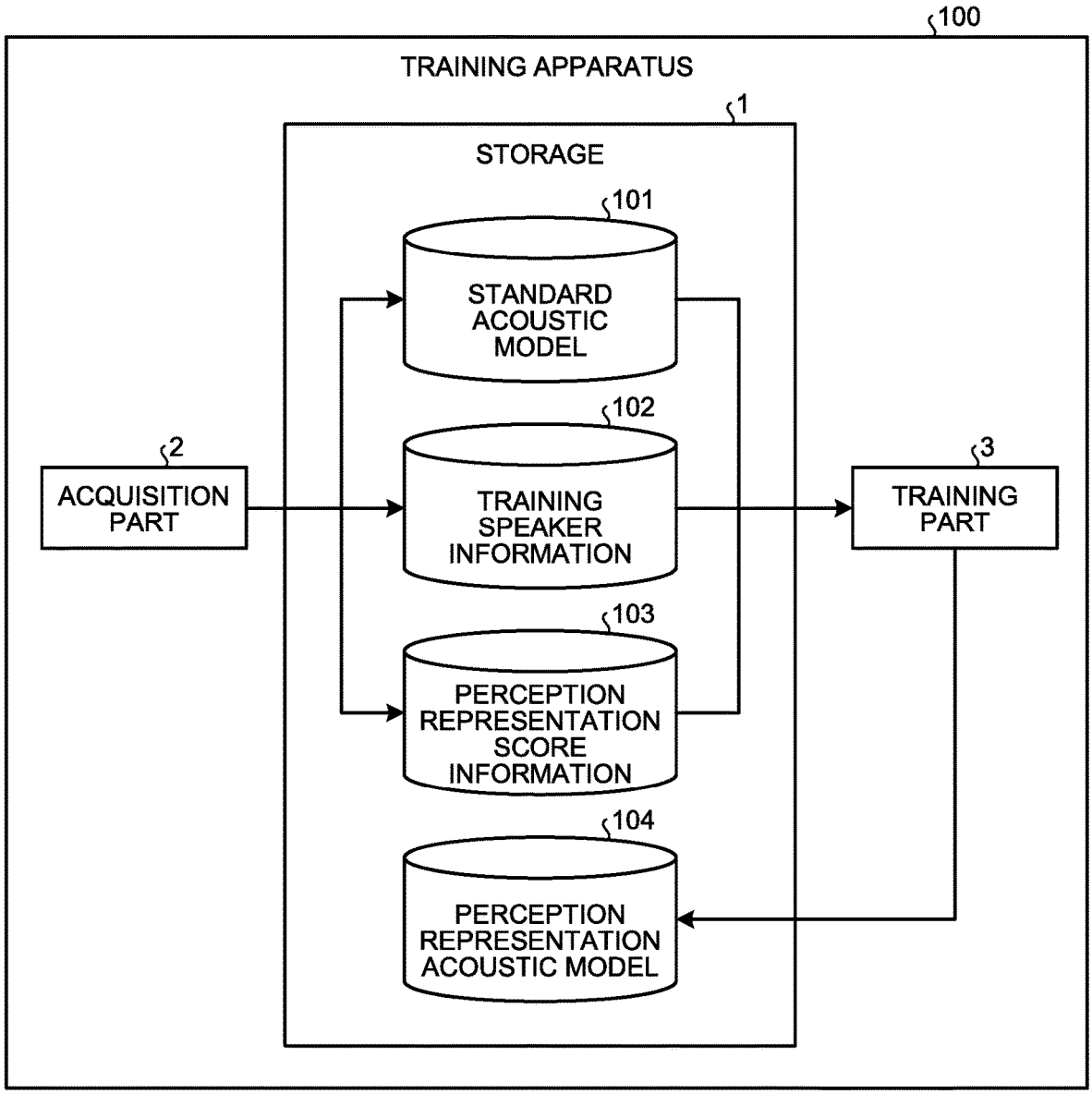
FIG. 1 illustrates a functional block diagram of a training apparatus according to the first embodiment.

FIG. 1 illustrates a functional block diagram of a training apparatus according to the first embodiment. The training apparatus 100 includes a storage 1, an acquisition part 2 and a training part 3.

The storage 1 stores a standard acoustic model 101, training speaker information 102, perception representation score information 103 and a perception representation acoustic model 104.

The acquisition part 2 acquires the standard acoustic model 101, the training speaker information 102 and the perception representation score information 103 from such as another apparatus.

Here, it explains the standard acoustic model 101, the training speaker information 102 and the perception representation score information 103.

The standard acoustic model 101 is utilized to train the perception representation acoustic model 104.

Before the explanation of the standard acoustic model 101, it explains examples of acoustic models. In the HMM-based speech synthesis, acoustic models represented by HSMM (Hidden Semi-Markov Model) are utilized. In the HSMM, output distributions and duration distributions are represented by normal distributions, respectively.

In general, the acoustic models represented by HSMM are constructed by the following manner.

(1) From speech waveform of a certain speaker, it extracts prosody parameters for representing pitch variations in time domain and speech parameters for representing information of phoneme and tone.

(2) From texts of the speech, it extracts context information for representing language attribute. The context information is information that representing context of information that is utilized as speech unit for classifying an HMM model. The speech unit is such as phoneme, half phoneme and syllable. For example, in the case where the speech unit is phoneme, it can utilize a sequence of phoneme names as the context information.

(3) Based at least in part on the context information, it clusters the prosody parameters and the speech parameters for each state of HSMM by utilizing decision tree.

(4) It calculates output distributions of HSMM from the prosody parameters and the speech parameters in each leaf node obtained by performing decision tree clustering.

(5) It updates model parameters (output distributions) of HSMM based at least in part on a likelihood maximization criterion of EM (Expectation-Maximization) algorithm.

(6) In a similar or same manner, it performs clustering for parameters indicating speech duration corresponding to the context information, and stores normal distributions of the parameters to each leaf node obtained by the clustering, and updates model parameters (duration distributions) by EM algorithm.

The HSMM-based speech synthesis models features of tone and accent of speaker by utilizing the processes from (1) to (6) described above.

The standard acoustic model 101 is an acoustic model for representing an average voice model $M_0$. The model $M_0$ is constructed by utilizing acoustic data extracted from speech waveforms of various kinds of speakers and language data.

The model parameters of the average voice model $M_0$ represent acoustic features of average voice characteristics obtained from the various kinds of speakers.

Here, the speech features are represented by acoustic features. The acoustic features are such as parameters related to prosody extracted from speech and parameters extracted from speech spectrum that represents phoneme, tone and so on.

In particular, the parameters related to prosody are time series date of fundamental frequency that represents tone of speech.

The parameters for phoneme and tone are acoustic data and features for representing time variations of the acoustic data. The acoustic data is time series data such as cepstrum, mel-cepstrum, LPC (Linear Predictive Coding) mel-LPC, LSP (Line Spectral Pairs) and mel-LSP and data indicating ratio of periodic and non-periodic of speech.

The average voice model $M_0$ is constructed by decision tree created by context clustering, normal distributions for representing output distributions of each state of HMM, and normal distributions for representing duration distributions. Here, details of the construction way of the average voice model $M_0$ is written in the Junichi Yamagishi and Takao Kobayashi, "Average-voice-based speech synthesis using HSMM-based speaker adaptation and adaptive training", IEICE Transactions Information & Systems, vol. E90-D, no. 2, pp. 533-543, February 2007 (hereinafter also referred to as Literature 3).

The training speaker information 102 is utilized to train the perception representation acoustic model 104. The training speaker information 102 is stored with association information of acoustic data, language data and acoustic model for each training speaker. The training speaker is a speaker of training target of the perception representation acoustic model 104. Speech of the training speaker is featured by acoustic data, language data and acoustic model. For example, the acoustic model for the training speaker can be utilized for recognizing speech uttered by the training speaker.

The language data is obtained from text information of uttered speech. In particular, the language data is such as phoneme, information related to utterance method, end phase position, text length, expiration paragraph length, expiration paragraph position, accent phrase length, accent phrase position, word length, word position, mora length, mora position, syllable position, vowel of syllable, accent type, modification information, grammatical information and phoneme boundary information. The phoneme boundary information is information related to precedent, before precedent, subsequence and after subsequence of each language feature. Here, the phoneme can be half phoneme.

The acoustic model of the training speaker information 102 is constructed from the standard acoustic model 101 (the average voice model $M_0$), the acoustic data of the training speaker and the language data of the training speaker. In particular, the acoustic model of the training speaker information 102 is constructed as a model that has the same structure as the average voice model $M_0$ by utilizing speaker adaptation technique written in the Literature 3. Here, if there is speech of each training speaker for each one of various utterance manners, the acoustic model of the training speaker for the each one of various utterance manners may be constructed. For example, the utterance manners are such as reading type, dialog type and emotional voice.

The perception representation score information 103 is utilized to train the perception representation acoustic model 104. The perception representation score information 103 is information that expresses voice quality of speaker by a score of speech perception representation. The speech perception representation represents non-linguistic voice features that are felt when it listens to human speech. The perception representation is such as brightness of voice, gender, age, deepness of voice and clearness of voice. The perception representation score is information that represents voice features of speaker by scores (numerical values) in terms of the speech perception representation.

FIG. 2 illustrates an example of the perception representation score information according to the first embodiment. The example of FIG. 2 shows a case where scores in terms of the perception representation for gender, age, brightness, deepness and clearness are stored for each training speaker ID. Usually, the perception representation scores are scored based at least in part on one or more evaluators' feeling when they listen to speech of training speaker. Because the perception representation scores depend on subjective evaluations by the evaluators, it is considered that its tendency is different based at least in part on the evaluators. Therefore, the perception representation scores are represented by utilizing relative differences from speech of the standard acoustic model, that is speech of the average voice model $M_0$.

For example, the perception representation scores for training speaker ID M001 are +5.3 for gender, +2.4 for age, −3.4 for brightness, +1.2 for deepness and +0.9 for clearness. In the example of FIG. 2, the perception representation scores are represented by setting scores of synthesized speech from the average voice model $M_0$ as standard (0.0). Moreover, higher score means the tendency is stronger. Here, in the perception representation scores for gender, positive case means that the tendency for male voice is strong and the negative case means that the tendency for female voice is strong.

Here, a particular way for putting the perception representation scores can be defined accordingly.

For example, for each evaluator, after scoring original speech or synthesized speech of the training speaker and synthesized speech from the average voice model $M_0$ separately, the perception representation scores may be calculated by subtracting the perception representation scores of the average voice model $M_0$ from the perception representation scores of the training speaker.

Moreover, after each evaluator listens to original speech or synthesized speech of the training speaker and synthesized speech from the average voice model $M_0$ successively, the perception representation scores that indicate the differences between the speech of the training speaker and the synthesized speech from the average voice model $M_0$ may be scored directly by each evaluator.

The perception representation score information 103 stores the average of perception representation scores scored by each evaluator for each training speaker. In addition, the storage 1 may store the perception representation score information 103 for each utterance. Moreover, the storage 1 may store the perception representation score information 103 for each utterance manner. For example, the utterance manner is such as reading type, dialog type and emotional voice.

The perception representation acoustic model 104 is trained by the training part 3 for each perception representation of each training speaker. For example, as the perception representation acoustic model 104 for the training speaker ID M001, the training part 3 trains a gender acoustic model in terms of gender of voice, an age acoustic model in terms of age of voice, a brightness acoustic model in terms of voice brightness, a deepness acoustic model in terms of voice deepness and a clearness acoustic model in terms of voice clearness.

The training part 3 trains the perception representation acoustic model 104 of the training speaker from the standard acoustic model 101 (the average voice model $M_0$) and voice features of the training speaker represented by the training speaker information 102 and the perception representation score information 103, and stores the perception representation acoustic model 101 in the storage 1.

Hereinafter, it explains an example of training process of the perception representation acoustic model 104 specifically.

Figure 3:
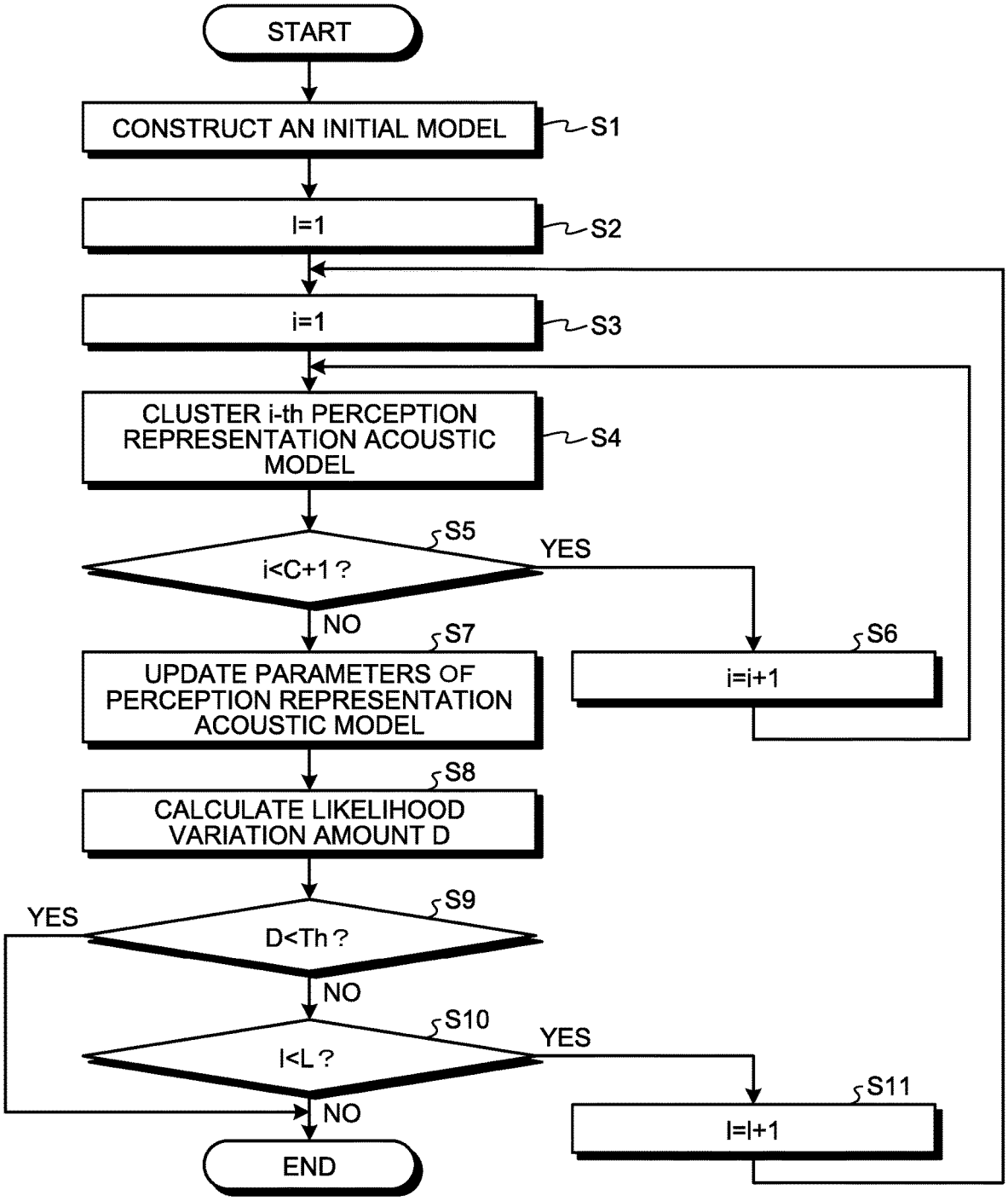
FIG. 3 illustrates a flow chart of the example of the training process according to the first embodiment.

FIG. 3 illustrates a flow chart of the example of the training process according to the first embodiment. First, the training part 3 constructs an initial model of the perception representation acoustic model 104 (step S1).

In particular, the initial model is constructed by utilizing the standard acoustic model 101 (the average voice model $M_0$), an acoustic model for each training speaker included in the training speaker information 102, and the perception representation score information 103. The initial model is a multiple regression HSMM-based model.

Here, it explains the multiple regression HSMM-based model briefly. For example, the details of the multiple regression HSMM-based model is described in the Makoto Tachibana, Takashi Nose, Junichi Yamagishi and Takao Kobayashi, "A technique for controlling voice quality of synthetic speech using multiple regression HSMM," in Proc. INTERSPEECH2006-ICSLP, p. 2438-2441, 2006 (hereinafter also referred to as Literature 1). The multiple regression HSMM-based model is a model that represents an average vector of output distribution $N(\mu, \Sigma)$ of HSMM and an average vector of duration distribution $N(\mu, \Sigma)$ by utilizing the perception representation scores, regression matrix and bias vector.

The average vector of normal distribution included in an acoustic model is represented by the following formula (1).

$$\mu = Ew + b = \sum_{i=1}^{C} e_i w_i + b \tag{1}$$

Here, E is a regression matrix of I rows and C columns. I represent the number of training speakers. C represents kinds of perception representations. $w=[w_1, w_2, \ldots w_c]^T$ is a perception representation score vector that has C elements. Each of C elements represents a score of corresponding perception representation. Here, T represents transposition. b is a bias vector that has I elements.

Each of C column vectors $\{e_1, e_2, \ldots, e_c\}$ included in the regression matrix E represents an element corresponding to the perception representation, respectively. Hereinafter, the column vector included in the regression matrix E is called element vector. For example, in the case where kinds of the perception representations are the example in FIG. 2, the regression matrix E includes $e_1$ for gender, $e_2$ for age, $e_3$ for brightness, $e_4$ for deepness and $e_5$ for clearness.

In the perception representation acoustic model 104, because parameters of each perception representation acoustic model have the one equivalent to element vector $e_i$ of the regression matrix E of the multiple regression HSMM, the regression matrix E can be utilized as initial parameters for the perception representation acoustic model 104. In general, for the multiple regression HSMM, the regression matrix E (element vectors) and the bias vector are calculated based at least in part on a certain optimization criterion such as a likelihood maximization criterion and minimum square error criterion. The bias vector calculated by this method includes values that are efficient to represent data utilized for calculation in terms of the optimization criteria utilized. In other words, in the multiple regression HSMM, it calculates the values that become the center of acoustic space represented by acoustic data for model training.

Here, because the bias vector centered in the acoustic space in the multiple regression HSMM is not calculated based at least in part on a criterion of human's perception for speech, it is not guaranteed that the consistency between the center of acoustic space represented by the multiple regression HSMM and the center of space that represents the human's perception for speech. On the other hand, the perception representation score vector represents perceptive differences of voice quality between synthesized speech from the average voice model $M_0$ and speech of training speaker. Therefore, when human's perception for speech is used as a criterion, it can be seen that the center of acoustic space is the average voice model $M_0$.

Therefore, by utilizing average parameters of the average voice model $M_0$ as the bias vector of the multiple regression HSMM, it can perform model construction with the clear consistency between the center of perceptive space and the center of acoustic space.

Hereinafter, it explains concrete construction way of the initial model. Here, it explains an example of the construction way that utilizes a minimum square error criterion.

First, the training part 3 obtains normal distributions of output distributions of HSMM and normal distributions of duration distributions from the average voice model $M_0$ of the standard acoustic model 101 and acoustic model of each training speaker included in the training speaker information 102. Then, the training part 3 extracts an average vector from each normal distribution and concatenates the average vectors.

Figure 4:
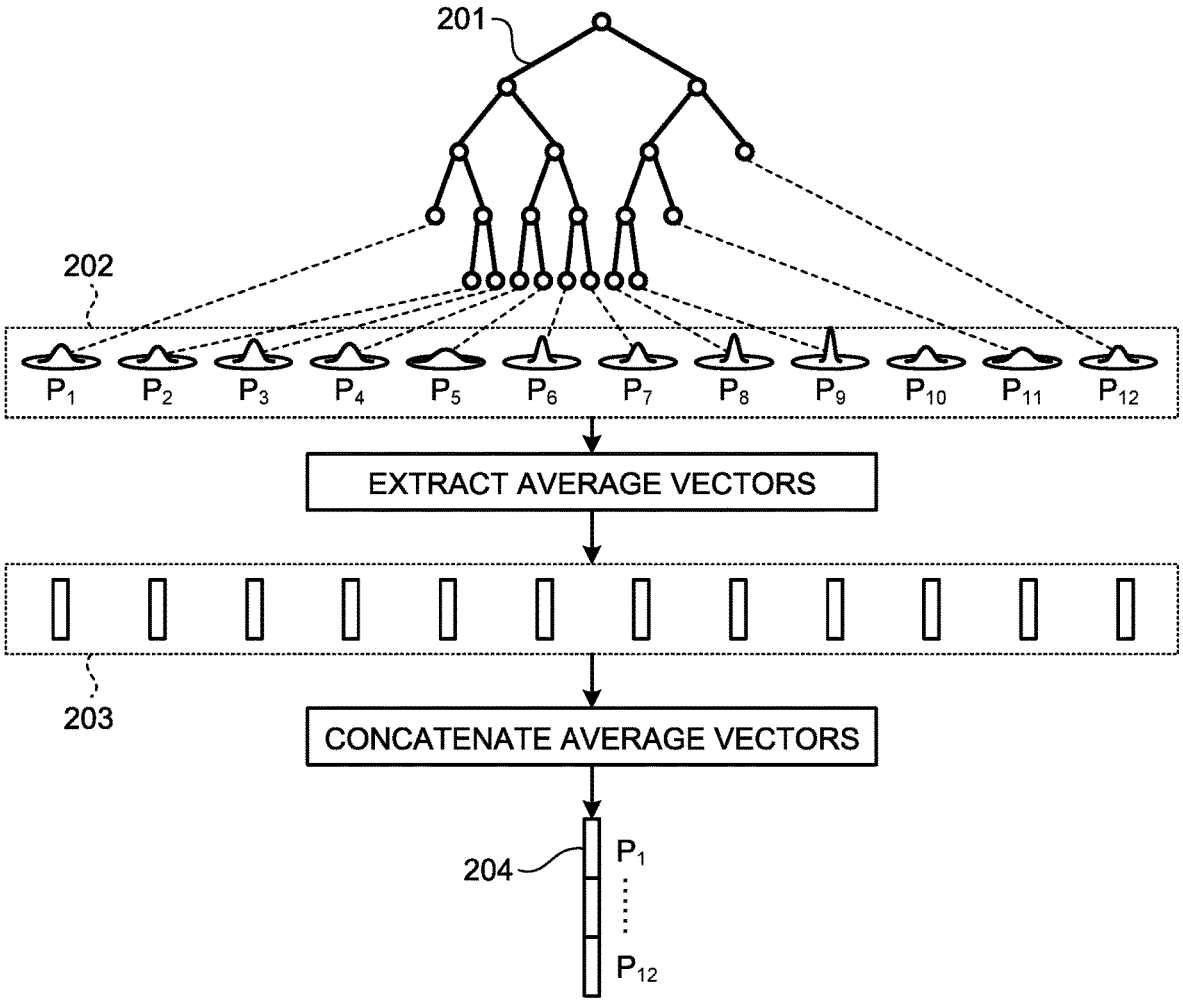
FIG. 4 is a figure that shows outline of an example of extraction and concatenation processes of the average vectors 203 according to the first embodiment.

FIG. 4 is a figure that shows outline of an example of extraction and concatenation processes of the average vectors 203 according to the first embodiment. As shown in FIG. 4, leaf nodes of the decision tree 201 are corresponding to the normal distributions 202 that express acoustic features of certain context information. Here, symbols $P_1$ to $P_{12}$ represent indexes of the normal distributions 202.

First, the training part 3 extracts the average vectors 203 from the normal distributions 202. Next, the training part 3 concatenates the average vector 203 in ascending order or descending order of indexes based at least in part on the indexes of the normal distributions 202 and constructs the concatenated average vector 204.

The training part 3 performs the processes of extraction and concatenation of the average vectors described in FIG. 4 for the average voice model $M_0$ of the standard acoustic model 101 and the acoustic model of each training speaker included in the training speaker information 102. Here, as described above, the average voice model $M_0$ and the acoustic model of each training speaker have the same structure. In other words, because decision trees in the acoustic models have the same structure, each element of the all concatenated average vectors corresponds acoustically among the concatenated average vectors. In other words, each element of the average concatenated vector corresponds to the normal distribution of the same context information.

Next, it calculates the regression matrix E with minimum square error criterion by utilizing the formula (2) where the concatenated average vector is an objective variable and perception representation score vector is an explanatory variable.

$$\tilde{E} = \underset{E}{\operatorname{argmin}} \sum_{s=1}^{S} \{\mu^{(s)} - (Ew^{(s)} + \mu^{(0)})\}^T \{\mu^{(s)} - (Ew^{(s)} + \mu^{(0)})\} \tag{2}$$

Here, s represents an index to identify the acoustic model of each training speaker included in the training speaker information 102. $w^{(s)}$ represents the perception representation score vector of each training speaker. $\mu^{(s)}$ represents the concatenated average vector of the acoustic model of each training speaker. $\mu^{(0)}$ represents the concatenated average vector of the average voice model $M_0$.

By the formula (2), the regression matrix E of the following formula (3) is obtained.

$$\tilde{E} = \left\{ \sum_{s=1}^{S} (\mu^{(s)} - \mu^{(0)}) w^{(s)} \right\} \left( w^{(s)} w^{(s)T} \right)^{-1} \tag{3}$$

Each element of element vectors (column vectors) of each regression matrix E calculated by the formula (3) represents the acoustic differences between the average vector of the average voice model $M_0$ and speech expressed by each perception representation score. Therefore, the each element of element vectors can be seen the average parameter stored by the perception representation acoustic model 104.

Moreover, because each element of the element vectors is made from the acoustic model of training speaker that has the same structure as the average voice model $M_0$, each element of the element vectors may have the same structure as the average voice model $M_0$. Therefore, the training part 3 utilizes the each element of element vectors as the initial model of the perception representation acoustic model 104.

Figure 5:
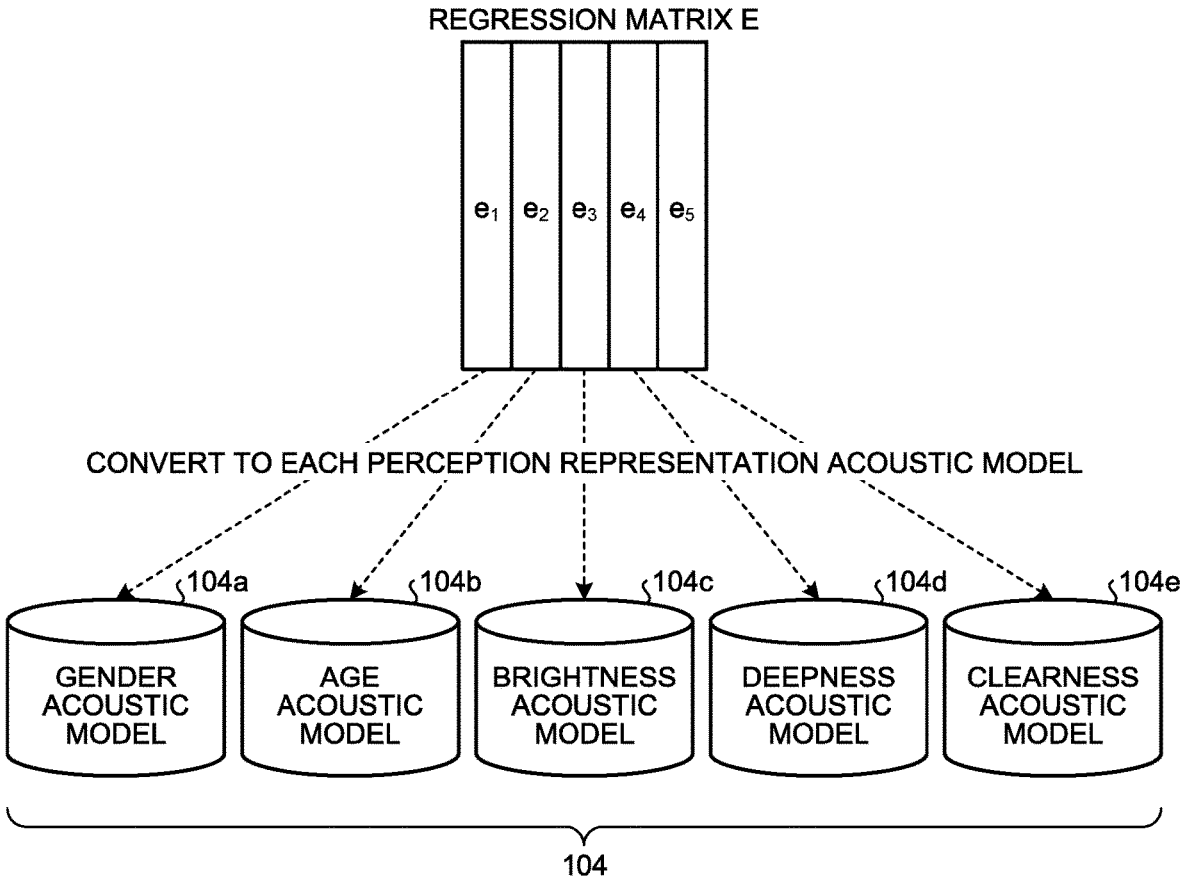
FIG. 5 illustrates an example of the correspondence between the regression matrix E and the perception representation acoustic model 104 according to the first embodiment.

FIG. 5 illustrates an example of the correspondence between the regression matrix E and the perception representation acoustic model 104 according to the first embodiment. The training part 3 converts the column vectors (the element vectors $\{e_1, e_2, \ldots, e_5\}$) of the regression matrix E to the perception representation acoustic model 104 (104$_a$ to 104$_e$) and sets as the initial value for each perception representation acoustic model.

Here, it explains the way to convert the element vectors $\{e_1, e_2, \ldots, e_5\}$ of the regression matrix E to the perception representation acoustic model 104 (104$_a$ to 104$_e$). The training part 3 performs the inverse processes of the extraction and concatenation processes of average vectors described in FIG. 4. Here, each element of the concatenated average vector for calculating the regression matrix E is constructed such that index numbers of the normal distributions correspond to the average vectors included in the concatenated average vector become the same order. Moreover, each element of element vectors $e_1$ to $e_5$ of the regression matrix E is in the same order as the concatenated average vector in FIG. 4 and corresponds to each normal distribution of each average vector included in the concatenated average vector. Therefore, from the element vectors of the regression matrix E, the training part 3 extracts element corresponding to index of the normal distribution of the average voice model $M_0$ and creates the initial model of the perception representation acoustic model 104 by replacing the average vector of normal distribution of the average voice model $M_0$ by the element.

Hereinafter, the perception representation acoustic model 104 is represented by $M_p=\{M_1, M_2, \ldots, M_c\}$. Here, C is the kinds of perception representations. The acoustic model $M^{(s)}$ of s-th training speaker is represented by the following formula (4) using the average voice model $M_0$, the perception representation acoustic model 104 ($M_P=\{M_1, M_2, \ldots, M_c\}$) and the perception representation vector $w^{(s)}=[w_1^{(s)}, w_2^{(s)}, \ldots, w_I^{(s)}]$ of s-th training speaker.

$$M^{(s)} = \sum_{i=1}^{C} M_i w_i^{(s)} + M_0 \tag{4}$$

In FIG. 3, the training part 3 initializes the valuable 1 that represents the number of updates of model parameters of the perception representation acoustic model 104 to 1 (step S2). Next, the training part 3 initializes an index i that identifies the perception representation acoustic model 104 ($M_i$) to be updated to 1 (step S3).

Next, the training part 3 optimizes the model structure by performing the construction of decision tree of the i-th perception representation acoustic model 104 using context clustering. In particular, as an example of the construction way of decision tree, the training part 3 utilizes the common decision tree context clustering. Here, the details of the common decision tree context clustering are written in the Junichi Yamagishi, Masatsune Tamura, Takashi Masuko, Takao Kobayashi, Keiichi Tokuda, "A Study on A Context Clustering Technique for Average Voice Models", IEICE technical report, SP, Speech, 102(108), 25-30, 2002 (hereinafter also referred to as Literature 4). And, the details of the common decision tree context clustering are also written in the J. Yamagishi, M. Tamura, T. Masuko, K. Tokuda, and T. Kobayashi, "A Context Clustering Technique for Average Voice Models," IEICE Trans. Information and Systems, E86-D, no. 3, pp. 534-542, March 2003 (hereinafter also referred to as Literature 2).

Here, it explains the outline of the common decision tree context clustering in step S4 and the difference from the Literature 3.

In the common context clustering, when it utilizes data of a plurality of training speakers, it performs node splitting of decision tree by considering the following two conditions.

(1) Data of all speakers exists in two nodes after splitting.

(2) It satisfies a minimum description length (MDL) criterion in node splitting.

Here, MDL is one of model selection criteria in information theory and is defined by log likelihood of model and the number of model parameters. In HMM-based speech synthesis, it performs clustering in a condition that it stops node splitting when the node splitting increases MDL.

In the Literature 3, as training speaker likelihood, it utilizes the training speaker likelihood of speaker dependent acoustic model constructed by utilizing only data of the training speaker.

On the other hand, in step S4, as training speaker likelihood, the training part 3 utilizes the training speaker likelihood of acoustic model $M^{(s)}$ of the training speaker given by the above formula (4).

By following the conditions described above, the training part 3 constructs the decision tree of the i-th perception representation acoustic model 104 and optimizes the number of distributions included in the i-th perception representation acoustic model. Here, the structure of the decision tree (the number of distributions) of the perception representation acoustic model $M^{(i)}$ given by step S4 is different from the number of distributions of the other perception representation acoustic model $M^{(j)}$ ($i \neq j$) and the number of distributions of the average voice model $M_0$.

Next, the training part 3 judges whether the index i is lower than C+1 (C is kinds of perception representations) or not (step S5). When the index i is lower than C+1 (Yes in step S5), the training part 3 increments i (step S6) and backs to step 4.

When the index i is equal to or higher than C+1 (No in step S5), the training part 3 updates model parameters of the perception representation model 104 (step S7). In particular, the training part 3 updates the model parameters of the perception representation acoustic model 104 ($M^{(i)}$, i is an integer equal to or lower than C) by utilizing update algorithm that satisfies a maximum likelihood criterion. For example, the update algorithm that satisfies a maximum likelihood criterion is EM algorithm. More particularly, because there are differences between the average voice model $M_0$ and the model structure of each perception representation acoustic model ($M^{(i)}$, i is an integer equal to or lower than C), as parameter update method, it utilizes the average parameter update method written in the V. Wan et al., "Combining multiple high quality corpora for improving HMM-TTS," Proc. INTERSPEECH, Tue.O5d.01, September 2012 (hereinafter also referred to as Literature 5).

The average parameter update method written in the Literature 5 is a method to update average parameters of each cluster in speech synthesis based at least in part on cluster adaptive training. For example, in the i-th perception representation acoustic model 104 ($M_i$), for updating distribution parameter $e_{i,n}$, statistic of all contexts that belong to this distribution is utilized.

The parameters to be updated are in the following formula (5).

$$\tilde{e}_{i,n} = \left( \sum_{m \in M_i(n)} G_{ii}^{(m)} \right)^{-1} \left\{ \sum_{m \in M_i(n)} \left( k_i^{(m)} - u_i^{(m)} - \sum_{j=1, j \neq i}^{C} G_{ij}^{(m)} e_j(m) \right) \right\} \tag{5}$$

Here, $G_{ij}^{(m)}$, $k_i^{(m)}$ and $u_i^{(m)}$ are represented by the following formulas (6) to (8).

$$G_{ij}^{(m)} = \sum_{s,t} \gamma_t^{(s)}(m) w_i^{(s)} \Sigma_0^{-1} w_j^{(s)} \tag{6}$$

$$k_i^{(m)} = \sum_{s,t} \gamma_t^{(s)}(m) w_i^{(s)} \Sigma_0^{-1} O_t^{(s)} \tag{7}$$

$$u_i^{(m)} = \sum_{s,t} \gamma_t^{(s)}(m) w_i^{(s)} \Sigma_0^{-1} \mu_0(m) \tag{8}$$

$O_t^{(s)}$ is acoustic data of training speaker s at time t, $\gamma_t^{(s)}$ is occupation possibility related to context m of the training speaker s at time t, $\mu_0(m)$ is an average vector corresponding to the context m of the average voice model $M_0$, $\Sigma_0(m)$ is a covariance matrix corresponding to the context m of the average voice model $M_0$, $e_j(m)$ is an element vector corresponding to the context m of the j-th perception representation acoustic model 104.

Because the training part 3 updates only parameters of perception representation without performing update of the perception representation score information 103 of each speaker and model parameters of the average voice model $M_0$ in step S7, it can train the perception representation acoustic model 104 precisely without causing dislocation from the center of perception representation.

Next, the training part 3 calculates likelihood variation amount D (step S8). In particular, the training part 3 calculates likelihood variation before and after update of model parameters. First, before the update of the model parameters, for the acoustic model $M^{(s)}$ of training speaker represented by the above formula (4), the training part 3 calculates likelihoods of the number of training speakers for data of corresponding training speaker and sums the likelihoods. Next, after the update of the model parameters, the training part 3 calculates the summation of likelihoods by using similar or the same manner and calculates the difference D from the likelihood before the update.

Next, the training part 3 judges whether the likelihood variation amount D is lower than the predetermined threshold Th or not (step S9). When the likelihood variation amount D is lower than the predetermined threshold Th (Yes in step S9), it finishes processing.

When the likelihood variation amount D is equal to or higher than the predetermined threshold Th (No in step S9), the training part 3 judges whether the valuable 1 that represents the number of updates of model parameters is lower than the maximum update numbers L (step S10). When the valuable 1 is equal to or higher than L (No in step S10), it finishes processing. When the valuable 1 is lower than L (Yes in step S10), the training part 3 increments 1 (step S11), and it backs to step S3.

In FIG. 1, the training part 3 stores the perception representation acoustic model 104 trained by the training processes illustrated in FIG. 3 on the storage 1.

In summary, for each perception representation, the perception representation acoustic model 104 is a model that models the difference between average voice and acoustic data (duration information) that represents features corresponding to each perception representation from the perception representation score vector of each training speaker, acoustic data (duration information) clustered based at least in part on context of each training speaker, and the output distribution (duration distribution) of the average voice model.

The perception representation acoustic model 104 has decision trees, output distributions and duration distributions of each state of HMM. On the other hand, output distributions and duration distributions of the perception representation acoustic model 104 have only average parameters.

As described above, in the training apparatus 100 according to the first embodiment, by utilizing the above training processes, the training part 3 trains one or more perception representation acoustic model 104 corresponding to one or more perception representation from the standard acoustic model 101 (the average voice model $M_0$), the training speaker information 102 and the perception representation score information 103. In this way, the training apparatus 100 according to the first embodiment can train the perception representation acoustic mode 104 that performs the control of speaker characteristics for synthesizing speech precisely as intended by user.

Second Embodiment

Next, it explains the second embodiment. In the second embodiment, it explains a speech synthesis apparatus 200 that performs speech synthesis utilizing the perception representation acoustic mode 104 of the first embodiment.

Figure 6:
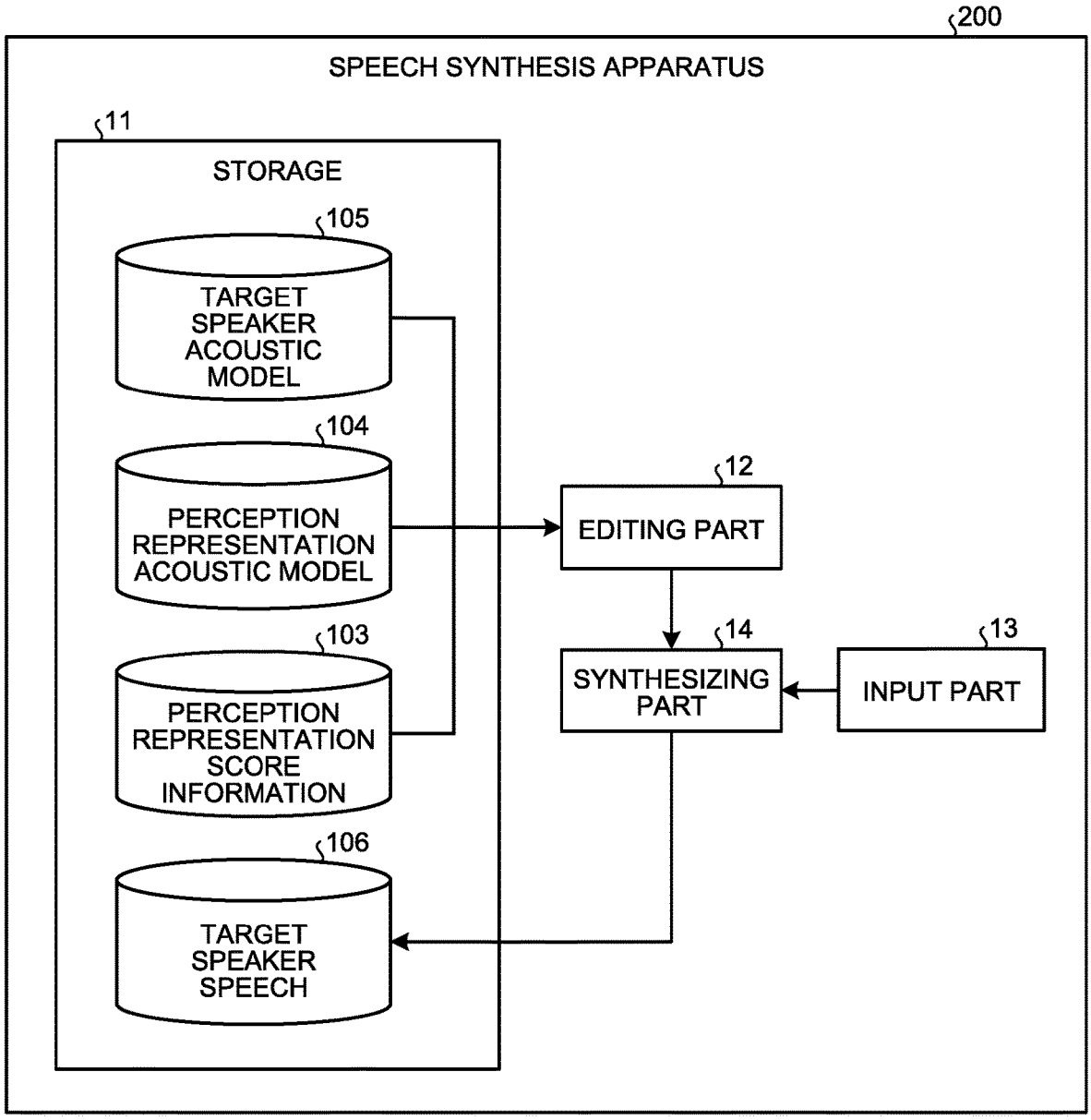
FIG. 6 illustrates an example of a functional block diagram of the speech synthesis apparatus 200 according to the second embodiment.

FIG. 6 illustrates an example of a functional block diagram of the speech synthesis apparatus 200 according to the second embodiment. The speech synthesis apparatus 200 according to the second embodiment includes a storage 11, an editing part 12, an input part 13 and a synthesizing part 14. The storage 11 stores the perception representation score information 103, the perception representation acoustic model 104, a target speaker acoustic model 105 and target speaker speech 106.

The perception representation score information 103 is the same as the one described in the first embodiment. In the speech synthesis apparatus 200 according to the second embodiment, the perception representation score information 103 is utilized by the editing part 12 as information that indicates weights in order to control speaker characteristics of synthesized speech.

The perception representation acoustic model 104 is a part or all of acoustic models trained by the training apparatus 100 according to the first embodiment.

The target speaker acoustic model 105 is an acoustic model of a target speaker who is to be a target for controlling of speaker characteristics. The target speaker acoustic model 105 has the same format as a model utilized by HMM-based speech synthesis. The target speaker acoustic model can be any model. For example, the target speaker acoustic model 105 may be an acoustic model of training speaker that is utilized for training of the perception representation acoustic model 104, an acoustic model of speaker that is not utilized for training, and the average voice model $M_0$.

The editing part 12 edits the target speaker acoustic model 105 by adding speaker characteristics represented by the perception representation score information 103 and the perception representation acoustic model 104 to the target speaker acoustic mode 105. In particular, as in similar or the same manner of the above formula (4), the editing part 12 weights each perception representation acoustic model 104 ($M_P=\{M_1, M_2, \ldots, M_c\}$) by the perception representation score information 103, and sums the perception representation acoustic model 104 with the target speaker acoustic model 105. In this way, it can obtain the target speaker acoustic model 105 with the speaker characteristics. The editing part 12 inputs the target speaker acoustic model 105 with the speaker characteristics to the synthesizing part 14.

The input part 13 receives an input of any text, and input the txt to the synthesizing part 14.

The synthesizing part 14 receives the target speaker acoustic model 105 with the speaker characteristics from the editing part 12 and the text from the input part 13, and performs speech synthesis of the text by utilizing the target speaker acoustic model 105 with the speaker characteristics. In particular, first, the synthesizing part 14 performs language analysis of the text and extracts context information from the text. Next, based at least in part on the context information, the synthesizing part 14 selects output distributions and duration distributions of HSMM for synthesizing speech from the target speaker acoustic model 105 with the speaker characteristics. Next, the synthesizing part 14 performs parameter generation by utilizing the selected output distributions and duration distributions of HSMM, and obtains a sequence of acoustic data. Next, the synthesizing part 14 synthesizes speech waveform from the sequence of acoustic data by utilizing vocoder, and stores the speech waveform as the target speaker speech 106 in the storage 11.

Next, it explains speech synthesis method according to the second embodiment.

Figure 7:
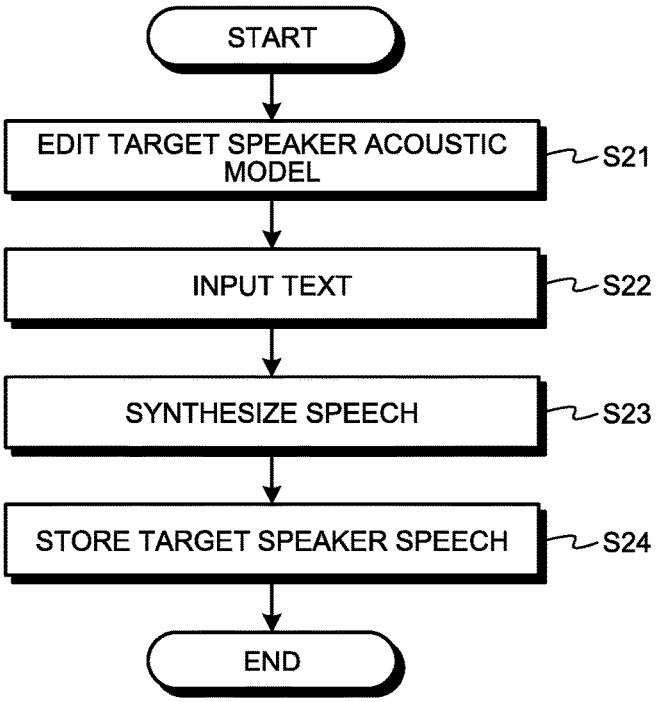
FIG. 7 illustrates a flow chart of an example of the speech synthesis method in the second embodiment.

FIG. 7 illustrates a flow chart of an example of the speech synthesis method in the second embodiment. First, the editing part 12 edits the target speaker acoustic model 105 by adding speaker characteristics represented by the perception representation score information 103 and the perception representation acoustic model 104 to the target speaker acoustic model 105 (step S21). Next, the input part 13 receives an input of any text (step S22). Next, the synthesizing part 14 performs speech synthesis of the text (inputted by step S22) by utilizing the target speaker acoustic model 105 with the speaker characteristics (edited by steps S21), and obtains the target speaker speech 106 (step S23). Next, the synthesizing part 14 stores the target speaker speech 106 obtained by step S22 in the storage 11 (step S24).

As described above, in the speech synthesis apparatus 200 according to the second embodiment, the editing part 12 edits the training speaker acoustic model 105 by adding speaker characteristics represented by the perception representation score information 103 and the perception representation acoustic model 104. Then, the synthesizing part 14 performs speech synthesis of text by utilizing the target speaker acoustic model 105 that has been added the speaker characteristics by the editing part 12. In this way, when synthesizing speech, the speech synthesis apparatus 200 according to the second embodiment can control the speaker characteristics precisely as intended by user, and can obtain the desired target speaker speech 106 as intended by user.

Finally, it explains a hardware configuration of the training apparatus according to the first embodiment and the speech synthesis apparatus 200 according to the second embodiment.

Figure 8:
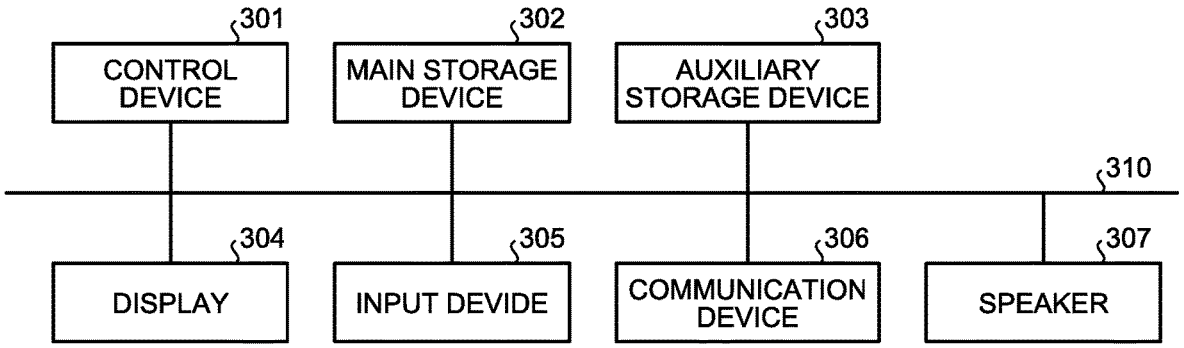
FIG. 8 illustrates a block diagram of an example of the hardware configuration of the training apparatus 100 according to the first embodiment and the speech synthesis apparatus 200 according to the second embodiment.

FIG. 8 illustrates a block diagram of an example of the hardware configuration of the training apparatus 100 according to the first embodiment and the speech synthesis apparatus 200 according to the second embodiment. The training apparatus according to the first embodiment and the speech synthesis apparatus 200 according to the second embodiment include a control device 301, a main storage device 302, an auxiliary storage device 303, a display 304, an input device 305, a communication device 306 and a speaker 307. The control device 301, the main storage device 302, the auxiliary storage device 303, the display 304, the input device 305, the communication device 306 and the speaker 307 are connected via a bus 310.

The main apparatus 301 executes a program that is read from the auxiliary storage device 303 to the main storage device 302. The main storage device 302 is a memory such as ROM and RAM. The auxiliary storage device 303 is such as a memory card and SSD (Solid Stage Drive).

The storage 1 and the storage 11 may be realized by the storage device 302, the storage device 303 or both of them.

The display 304 displays information. The display 304 is such as a liquid crystal display. The input device 305 is such as a keyboard and a mouse. Here, the display 304 and the input device 105 can be such as a liquid crystal touch panel that has both display function and input function. The communication device communicates with other apparatuses. The speaker 307 outputs speech.

The program executed by the training apparatus 100 according to the first embodiment and the speech synthesis apparatus 200 according to the second embodiment is provided as a computer program product stored as a file of installable format or executable format in computer readable storage medium such as CD-ROM, memory card, CD-R and DVD (Digital Versatile Disk).

It may be configured such that the program executed by the training apparatus 100 of the first embodiment and the speech synthesis apparatus 200 of the second embodiment is stored in a computer connected via network such as internet and is provided by download via internet. Moreover, it may be configured such that the program executed by the training apparatus 100 of the first embodiment and the speech synthesis apparatus 200 of the second embodiment is provided via network such as internet without downloading.

Moreover, it may be configured such that the program executed by the training apparatus 100 of the first embodiment and the speech synthesis apparatus 200 of the second embodiment is provided by embedding on such as ROM.

The program executed by the training apparatus 100 of the first embodiment and the speech synthesis apparatus 200 of the second embodiment has a module configuration including executable functions by the program among the functions of the training apparatus 100 of the first embodiment and the speech synthesis apparatus 200 of the second embodiment.

Reading and executing of the program from a storage device such as the auxiliary storage device 303 by the control device 301 enables the functions realized by the program to be loaded in the main storage device 302. In other words, the functions realized by the program are generated in the main storage device 302.

Here, a part or all of the functions of the training apparatus 100 according to the first embodiment and the speech synthesis apparatus 200 according to the second embodiment can be realized by hardware such as an IC (Integrated Circuit), processor, a processing circuit and processing circuitry. For example, the acquisition part 2, the training part 3, the editing part 12, the input part 13, and the synthesizing part 14 may be implemented by the hardware.

The terms used in each embodiment should be interpreted broadly. For example, the term "processor" may encompass but not limited to a general purpose processor, a central processing unit (CPU), a microprocessor, a digital signal processor (DSP), a controller, a microcontroller, a state machine, and so on. According to circumstances, a "processor" may refer but not limited to an application specific integrated circuit (ASIC), a field programmable gate array (FPGA), and a programmable logic device (PLD), etc. The term "processor" may refer but not limited to a combination of processing devices such as a plurality of microprocessors, a combination of a DSP and a microprocessor, one or more microprocessors in conjunction with a DSP core.

As another example, the term "memory" may encompass any electronic component which can store electronic information. The "memory" may refer but not limited to various types of media such as random access memory (RAM), read-only memory (ROM), programmable read-only memory (PROM), erasable programmable read only memory (EPROM), electrically erasable PROM (EEPROM), non-volatile random access memory (NVRAM), flash memory, magnetic or optical data storage, which are readable by a processor. It can be said that the memory electronically communicates with a processor if the processor read and/or write information for the memory. The memory may be integrated to a processor and also in this case, it can be said that the memory electronically communicates with the processor.

The term "circuitry" may refer to not only electric circuits or a system of circuits used in a device but also a single electric circuit or a part of the single electric circuit. The term "circuitry" may refer one or more electric circuits disposed on a single chip, or may refer one or more electric circuits disposed on more than one chip or device.

The entire contents of the Literatures 1, 3, 4, 5 are incorporated herein by reference.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A training apparatus for speech synthesis, the training apparatus comprising:

a storage device that stores an average voice model, training speaker information representing a feature of speech of a training speaker and perception representation score information represented by continuous scores of a plurality of perception representations related to voice quality of the training speaker, the average voice model constructed by utilizing acoustic data extracted from speech waveforms of a plurality of speakers and language data; and a hardware processor in communication with the storage device and configured to, based at least in part on the average voice model, the training speaker information, and the perception representation score information, train a plurality of perception representation acoustic models corresponding to the plurality of perception representations, wherein the perception representation score information comprises the continuous scores, each score representing a difference between original speech or synthesized speech of the training speaker, and speech synthesized from the average voice model.

2. The training apparatus according to claim 1, wherein the plurality of perception representations comprise at least two of gender, age, brightness, deepness, and clearness of speech.

3. The training apparatus according to claim 1, wherein the training speaker information comprises acoustic data representing speech of the training speaker, language data extracted from the acoustic data, or an acoustic model of the training speaker.

4. A speech synthesis apparatus comprising:

a storage device that stores a target speaker acoustic model corresponding to a target for speaker characteristic control, training speaker information representing features of speech of a training speaker, perception representation score information represented by continuous scores of a plurality of perception representations related to voice quality of the training speaker and a plurality of perception representation acoustic models corresponding to the plurality of perception representations; and a hardware processor configured to:

edit the target speaker acoustic model by adding speaker characteristic represented by the perception representation score information and the plurality of perception representation acoustic models to the target speaker acoustic model, and synthesize speech of text by utilizing the target speaker acoustic model after the editing of the target speaker acoustic model, wherein the perception representation score information comprises the continuous scores, each score representing a difference between original speech or synthesized speech of the training speaker, and speech synthesized from the average voice model.

5. The apparatus according to claim 4, wherein the plurality of perception representations comprise at least two of gender, age, brightness, deepness, and clearness of speech.

6. The apparatus according to claim 4, wherein the training speaker information comprises acoustic data representing speech of the training speaker, language data extracted from the acoustic data, or an acoustic model of the training speaker.

7. A training method applied to a training apparatus for speech synthesis, the training method comprising:

storing an average voice model, training speaker information representing a feature of speech of a training speaker, and perception representation score information represented by continuous scores of a plurality of perception representations related to voice quality of the training speaker, the average voice model constructed by utilizing acoustic data extracted from speech waveforms of a plurality of speakers and language data; and training, from the average voice model, the training speaker information, and the perception representation score information, a plurality of perception representation acoustic models corresponding to the plurality of perception representations, wherein the perception representation score information comprises the continuous scores, each score representing a difference between original speech or synthesized speech of the training speaker, and speech synthesized from the average voice model.

8. The method according to claim 7, wherein the plurality of perception representations comprise at least two of gender, age, brightness, deepness, and clearness of speech.

9. The method according to claim 7, wherein the training speaker information comprises acoustic data representing speech of the training speaker, language data extracted from the acoustic data, or an acoustic model of the training speaker.

* * * * *